United States Patent [19]

Halmaghi

[11] 4,027,682

[45] June 7, 1977

[54] CIGARETTE EXTINGUISHING AND CIGAR CUTTING DEVICE

[76] Inventor: Victor Halmaghi, 6211 Charing St., San Diego, Calif. 92117

[22] Filed: Aug. 9, 1976

[21] Appl. No.: 712,435

[52] U.S. Cl. ..... 131/233; 131/237; 131/250

[51] Int. Cl.[2] ..... A24F 13/24; A24F 15/10

[58] Field of Search ..... 131/233, 235 R, 237, 131/248, 250, 258

[56] References Cited

UNITED STATES PATENTS

| | | | |
|---|---|---|---|
| 1,256,636 | 2/1918 | Ambrose | 131/233 |
| 1,846,572 | 2/1932 | Schlegec | 131/237 |
| 2,690,184 | 9/1954 | Campbell | 131/237 |

FOREIGN PATENTS OR APPLICATIONS

| | | | |
|---|---|---|---|
| 436,775 | 10/1935 | United Kingdom | 131/237 |
| 357,851 | 10/1931 | United Kingdom | 131/232 X |

*Primary Examiner*—Stephen C. Pellegrino
*Attorney, Agent, or Firm*—Isbell & Charmasson

[57] ABSTRACT

A cigarette extinguishing and cigar cutting device mounted in the center of an ashtray which comprises a static base having a tapered top, a depressible stamper resiliently held above said base. Cigarettes may be snuffed out between the base and the depressed stamper. The cigar cutting portion of the device is constituted by a horizontal hole cut through a section of the base intercepted by a vertical slot in which travels a blade fastened to the stamper.

2 Claims, 5 Drawing Figures

CIGARETTE EXTINGUISHING AND CIGAR CUTTING DEVICE

BACKGROUND OF THE INVENTION

Numerous mechanical designs have been proposed in the past for cigarette extinguishers. None of these, however, are simple yet efficient enough to be used in such public places as waiting rooms, lobbies, restaurants and bars, or in a vehicle.

Simplicity of construction and of operation is the most desired features in an extinguisher intended for public usage. The design of the apparatus should not permit accumulation of ashes or tobacco debris in areas where they would impair its operation. Furthermore, the extinguisher components should lend themselves to the creation of an aesthetically attractive design.

SUMMARY OF THE INVENTION

The present invention embodies a cigarette extinguisher in which the burning end of a cigarette can be effectively crushed between a static base and a depressible stamper in combination with a guillotine type cigar cutter built into said base.

It also provides a device which is of simple construction, easy to operate, safe and aesthetically attractive.

Furthermore, the design is such that all ashes and tobacco debris fall freely into a supporting ashtray and will not interfere with the operation of the device.

IN THE DRAWING

DESCRIPTION OF THE PREFERRED EMBODIMENTS

Figure 1:
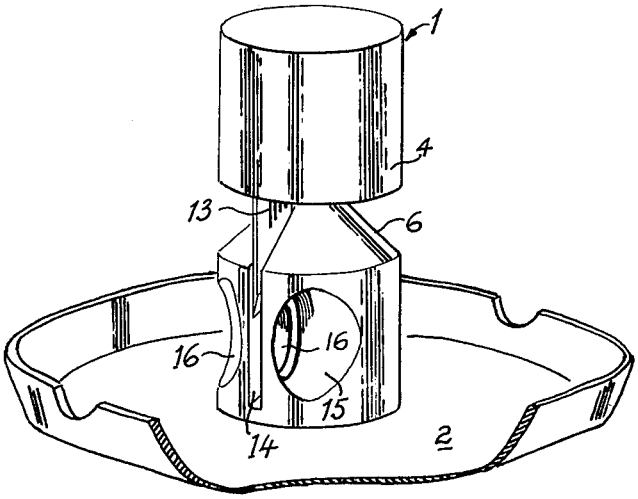
FIG. 1 is a perspective front elevation of the invention mounted in the center of an ashtray.
Figure 2:
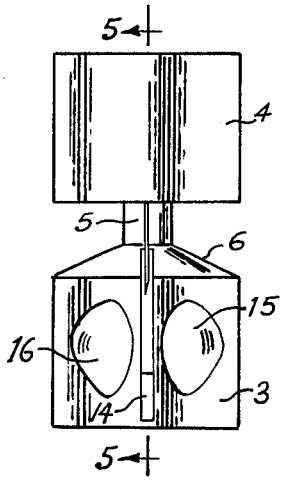
FIG. 2 is a front view thereof excluding the ashtray.
Figure 4:
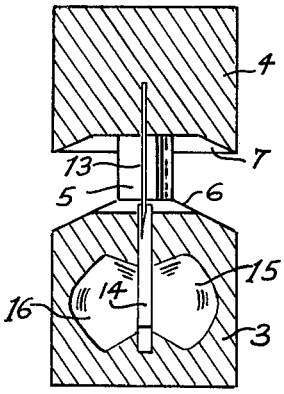
FIG. 4 is a cross-sectional view of FIG. 3 taken along line 4—4.
Figure 3:
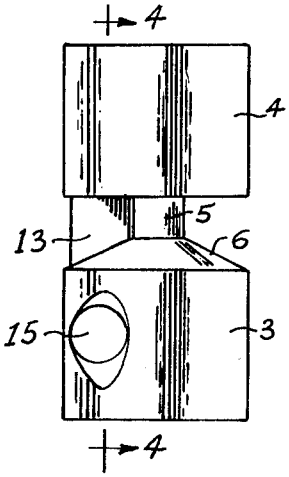
FIG. 3 is a right side view of FIG. 2.
Figure 5:
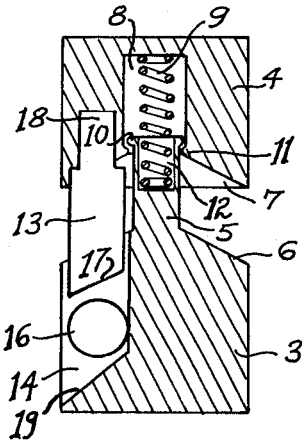
FIG. 5 is a cross-sectional view of FIG. 2 taken along line 5—5.

Referring to the drawing more specifically, FIG. 1 represents a cigarette extinguishing and cigar cutting device 1 embodying the present invention mounted in the center of an ashtray 2. The ashtray is omitted in FIGS. 2 through 5.

The base 3 of the device 1 is topped by a tapered summit area 6. Although a cylindrical base 3 topped by a conical summit 6 is shown here, a rectangular base having a pyramidal summit could have been used alternatively.

A stamper 4 mounted above the base 3 has a concave area 7 at the bottom, the outline of which matches the outline of the tapered summit 6. Extending vertically from the concave area 7 into the center of stamper 4 is a tubular cavity 8.

A shaft 5 extending vertically from the center of the tapered summit 6 is engaged into cavity 8.

The outside diameter of the shaft 5 is slightly smaller than the inside diameter of the cavity 8. The upper edge of the shaft 5 has a flanged area 10 which is force inserted past a narrowed collar area 11 around the lower lip of the cavity 8. The shaft 5 is therefore, captively secured into the cavity 8 and they, together, provide a sliding connection between the base 3 and the stamper 4.

A coil spring 9 resting in a small well 12 in the top of shaft 5 acting against the top of the cavity 8 provide a resilient means for holding the stamper 4 apart from the base 8.

The summit 6 in combination with the concave area of the stamper 7 forms a jaw into which the tip of a burning cigarette to be snuffed out, can be inserted. Depressing the stamper 4 will cause the end of the cigarette to be crushed. The resulting ashes and debris will fall along the tapered area 6 into the ashtray 2.

Note that the wiping action of the narrowed collar 11 against the shaft 5, prevents ashes and tobacco debris from entering the spring holding cavity 8 where they could accumulate and interfere with the operation of the device.

Alternatively the stamper 4 could be secured to the shaft 5 by means of the coil spring 9 rather than by means of the flange 10 and collar 11 combination described above. One end of the coil spring could be permanently fastened to the top of cavity 8 and the other end could be screwed in the well area 12, the walls of which would have been threaded to a pitch corresponding to the size and spacing of the spring coils.

The cigar cutter is located in a horizontal hole drilled across a lateral section of the base 3. The hole is made of two funnel-shaped areas 15 and 16 converging toward a vertical slot 14 which intercepts the hole perpendicularly. A blade 13 is fastened to the stamper 4 by having its upper extension 18 inbedded into the mass of the stamper 4. The blade travelling into the slot 14 clears the aperture constituted by hole 15–16 when the stamper is in the uppermost resting position; but will cut in a guillotine-like manner, the cigar end inserted into the hole 15–16 when the stamper is depressed.

The slot 14 extends slightly below the lowestmost reach of the sharpened edge 17 of the blade 13 to provide space for the cigar debris to fall easily down toward the ashtray along the slanted bottom 19 of the slot 14.

I claim:

1. A cigarette extinguishing device which comprises:
   - a base;
   - a depressable stamper having a central cavity extending vertically from the bottom and a narrowed collar around the lower lip of the cavity;
   - a central shaft extending vertically from said base into said cavity having a flanged area around the top edge which has been force inserted past said narrow collar;
   - a coil spring in said cavity for holding said stamper apart from said base; and
   - a cigar cutter comprising:
   - a lateral section of the base having a generally horizontal hole, and a vertical slot having a slanted bottom perpendicularly intercepting said hole; and
   - a blade having a sharpened lower edge, fastened to the stamper and travelling into the slot.

2. The device claimed in 1 wherein said generally horizontal hole is formed by two funnel-shaped areas converging toward said vertical slot.

* * * * *